US005753875A

United States Patent [19]

Benke et al.

[11] Patent Number: 5,753,875

[45] Date of Patent: May 19, 1998

[54] HEAT SINK FOR CONTACT STEMS OF A VACUUM INTERRUPTER AND A VACUUM INTERRUPTER THEREWITH

[75] Inventors: James J. Benke, Pittsburgh; Daniel Evan Palmieri, Aliquippa; Daniel Dickson Gress, Jr., Monroeville, all of Pa.

[73] Assignee: Eaton Corporation, Cleveland, Ohio

[21] Appl. No.: 732,538

[22] Filed: Oct. 15, 1996

[51] Int. Cl.[6] ..... H01H 33/66; H01H 1/62

[52] U.S. Cl. ..... 218/118; 200/289

[58] Field of Search ..... 218/118, 127, 218/128, 134–140, 155–157; 200/289; 361/673–678, 688–697, 704–713

[56] References Cited

U.S. PATENT DOCUMENTS

| | | | |
|---|---|---|---|
| 4,005,297 | 1/1977 | Cleaveland | 200/144 B |
| 4,376,235 | 3/1983 | Milianowicz | 200/50 |
| 4,384,179 | 5/1983 | Milianowicz | 200/50 |
| 4,695,924 | 9/1987 | Wozniczka | 361/386 |
| 5,473,208 | 12/1995 | Stihi | 310/68 D |
| 5,530,216 | 6/1996 | Benke et al. | 218/118 |

OTHER PUBLICATIONS

"Medium Voltage Current Transformer Systems" SA–111847, date unknown.

*Primary Examiner*—Cassandra C. Spyrou
*Assistant Examiner*—Michael J. Hayes
*Attorney, Agent, or Firm*—Martin J. Moran

[57] ABSTRACT

Heat sinks are placed on the contact stems of a vacuum interrupter between the vacuum bottle and junctions with the terminal conductors to lower the temperature of these junctions. The heat sinks are formed by a stack of thin laminations having central openings with inwardly directed tabs which bite into and secure the laminations to the stems. The laminations have aligned slots forming axial passages for cooling air. Preferably, the slots are enclosed to eliminate sharp peripheral edges to reduce the potential for flash over. In one embodiment, the slots are not formed by removing material but by bending it out of the plane of the lamination to maximize heat radiating surface area and to generate turbulent cooling air flow for increased cooling efficiency. An axially extending peripheral lip can provide axial spacing between laminations.

22 Claims, 6 Drawing Sheets

HEAT SINK FOR CONTACT STEMS OF A VACUUM INTERRUPTER AND A VACUUM INTERRUPTER THEREWITH

BACKGROUND OF THE INVENTION

1. Field of the Invention

This invention is directed to vacuum interrupters and more particularly to a vacuum interrupter with a heat sink for dissipating heat generated by current conducted by the vacuum interrupter.

2. Background Information

Vacuum interrupters are well known protection devices for electric power distribution systems. A fixed and a movable contact are enclosed within a vacuum chamber to facilitate interruption of an arc which extends between the contacts as they are separated to interrupt fault currents. The contacts are mounted on contact stems which extend out of opposite ends of the vacuum chamber where they are connected to electrical conductors in the protected system. The connectors between the contact stem carrying the movable contact and the fixed conductor of the power system must accommodate for the reciprocal movement of this movable stem. Various arrangements have been provided for this connection. One such arrangement employs a stack of thin flexible conductors such as are shown in U.S. Pat. Nos. 4,376,235; 4,384,179; and 5,530,216. Each of the thin flexible conductors has an opening with inwardly directed tabs which form an interference fit with and dig into the stem. Similar connections are provided for the stationary stem of the fixed contact. Other arrangements include bolts which clamp conductors to the contact stems; or sliding/rolling contact.

Vacuum interrupters must meet certain criteria such as not exceeding specified temperatures during operation. Temperatures are measured on each side of each current carrying junction. Thus, the temperatures of the stems, and of the conductors adjacent the connections between them must meet the temperature standards.

As technology has improved, the physical size of the contacts and the vacuum chamber of a vacuum interrupter which can interrupt a given current has been substantially reduced. This has resulted in the use of smaller diameter stems which of course raises the temperature of the smaller stems carrying the given current. This has made it even more difficult to comply with the temperature restrictions.

There have been some attempts to provide heat sinks to lower the temperature of the contact stems and connected conductors on vacuum interrupters. Thus, large blocks of copper, with fins machined into them have been bolted to the stems outside of the connection to the system conductor. Also, large castings with heating radiating fins have been used as part of a bolted connection. Such use of massive machined or cast parts adds significantly to the cost and weight of the connections. Another approach has been to bolt a copper plate to the end of the contact stem with radial fingers bent parallel to the stem; however, such devices have not been very effective in lowering the temperature of the stem or conductor. Bolted connections are subject to cyclical heat stress which can result in loosening of the connection leading to further increases in temperature at the connection. Rolling and sliding connections encounter abrasion of the silver plating on the copper members, thereby increasing the resistance and temperature of the connections.

There is a need therefore, for improved arrangements for reducing the temperatures reached by vacuum interrupters.

More particularly, there is a need for more effective heat sinks which do not require machining or cast parts.

There is a further need for such heat sinks which do not require bolted connections.

SUMMARY OF THE INVENTION

These needs and others are satisfied by the invention which is directed to a vacuum interrupter provided with heat radiating means fixed to one or both of the contact stems between the vacuum bottle and the junction of the contact stem with a current conductor. The heat radiating means is a heat sink having axially extending slots for the passage of cooling air. Preferably the axially extending slots are enclosed to eliminate sharp edges, and therefore, reduce the potential for flash over.

Preferably the heat sink comprises a stack of laminations each with a central opening having tabs which form an interference fit with and securing the lamination to the contact stem, thereby eliminating the need for a bolted or adhesive type connection. The slots in the individual laminations are aligned to provide the axial passages through the heat sink. Preferably the slots extend generally radially outward. The individual laminations can be circular or other shapes such as rectangular to accommodate the space provided by surrounding structure of the circuit breaker. The laminations can be provided with means spacing the laminations axially. Preferably this spacing means takes the form of a peripheral lip which may or may not be continuous. In one embodiment of the invention, material is not removed from the laminations to form the radial slots. Instead, vent sections are cut in the lamination by slits. These vent sections are then bent out of the plane of the lamination to form the slots. This configuration provides maximum surface area for heat radiation and also produces turbulent flow through swirling of the air passing through the slots. This embodiment is provided with spacers, preferably in the form of the peripheral lip to prevent flattening of the vent sections.

BRIEF DESCRIPTION OF THE DRAWINGS

A full understanding of the invention can be gained from the following description of the preferred embodiments when read in conjunction with the accompanying drawings in, which.

DESCRIPTION OF THE PREFERRED EMBODIMENT

The invention will be shown as applied to vacuum interrupters used in medium voltage switch gear. However, it will be realized by those skilled in the art that the invention has application to vacuum interrupters used in a variety of types of protection devices for electric power distribution systems. In fact, the heat sink can be used on any electrical device that needs a fixed joint connection.

Figure 1:
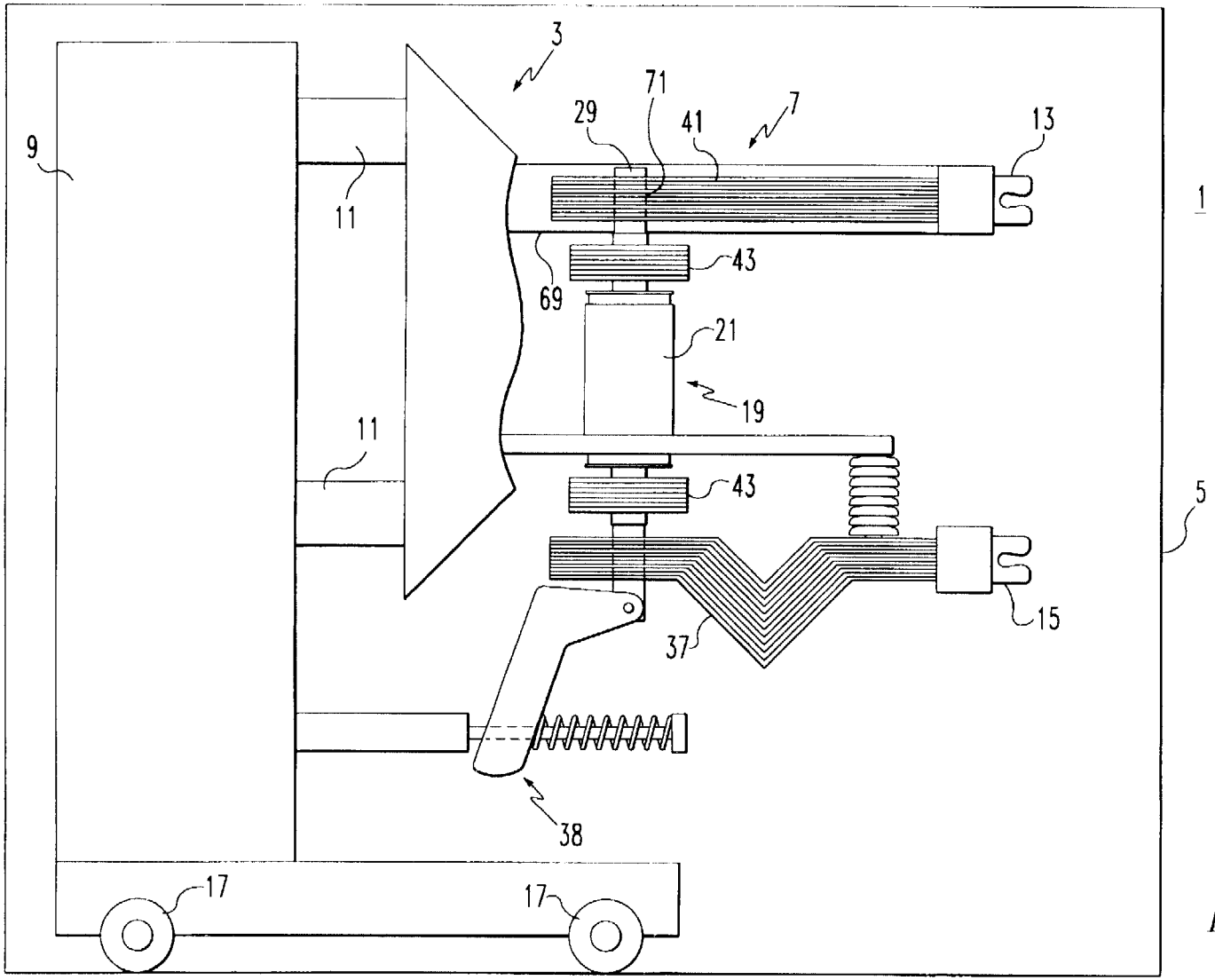
FIG. 1 is a schematic side elevation view of medium voltage switch gear incorporating the invention.

Referring to FIG. 1, the medium voltage switch gear 1 includes a circuit breaker 3 mounted within a metal enclosure 5. The circuit breaker 3 has a high voltage section 7 and a low voltage section 9 connected by insulative mountings 11. The high voltage section 7 includes, for each phase, line and load terminals 13 and 15 which connect to line and load buses (not shown), respectively, as the circuit breaker 3 is inserted fully into the enclosure 5 on rollers 17.

Figure 2:
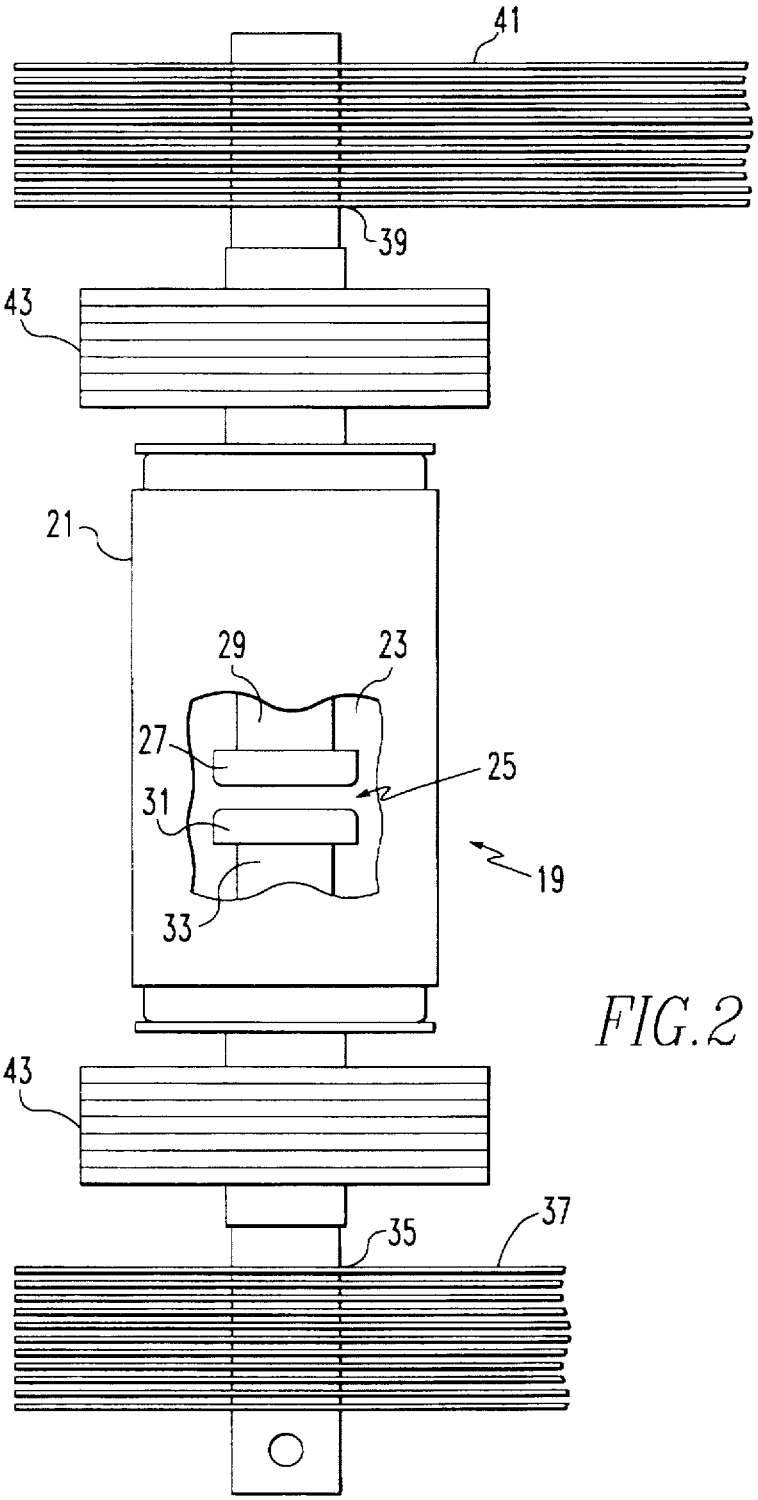
FIG. 2 is a side elevation view with part cut away of a vacuum interrupter provided with heat sinks in accordance with the invention.

The high voltage section 7 of the circuit breaker 3 further includes, for each pole, a vacuum interrupter 19. Each vacuum interrupter 19 includes a vacuum bottle 21 forming a vacuum chamber 23 housing a pair of separable contacts 25. As shown in FIG. 2, the separable contacts 25 include a fixed contact 27 mounted on the end of a fixed contact stem 29 and a movable contact 31 mounted on the end of a movable contact stem 33. The contact stems 29 and 33 extend out of opposite ends of the vacuum bottle 21. The movable contact stem 33 is connected at a junction 35 to one end of a flexible conductor 37 which is connected at its opposite end to the load terminal 15. Preferably, the flexible conductor 37 is of the type described in U.S. Pat. No. 5,530,216 or of the type described in U.S. Pat. Nos. 4,376,235, or 4,384,179. Such flexible conductors 37 are constructed of a stack of thin flexible sheets of a conductive material such as copper. An operating mechanism 38 actuated by components (not shown) in the low voltage section 9 of the circuit breaker raises and lowers the movable stem 33 to close and open the separable contacts 5 as is well known.

The fixed contact stem 29 is similarly secured at a junction 39 to one end of a conductor 41 which connects it to the line terminal 13. Preferably, this conductor 41 is also constructed of a stack of conductive sheets. While this conductor need not be flexible, the spaced laminations provide good heat dissipation especially since the sheets are separated by spacers in between at each end.

As mentioned, test standards for circuit breakers such as ANSI C37.04-1979, ANSI C37.09-1979, IEC 56, IEC 694, require that the closest current carrying device away from the vacuum interrupter 19, i.e., the junctions 35 and 39, may not have a temperature greater than 65° C. Improvements in the design of the vacuum interrupters 19 has resulted in the ability to achieve a given current rating with a physically smaller vacuum interrupter. The smaller physical size of the vacuum interrupter limits the diameters of the contact stems 29 and 33 to the extent that in some cases the temperature criteria cannot be met.

The present invention provides a solution to this problem by placing efficient heat sinks 43 on the fixed and movable contact stems 29 and 33 between the vacuum bottle 21 and the junction 35 and 39.

Figure 4:
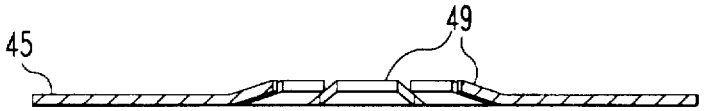
FIG. 4 is an edge view of the lamination of FIG. 3.
Figure 3:
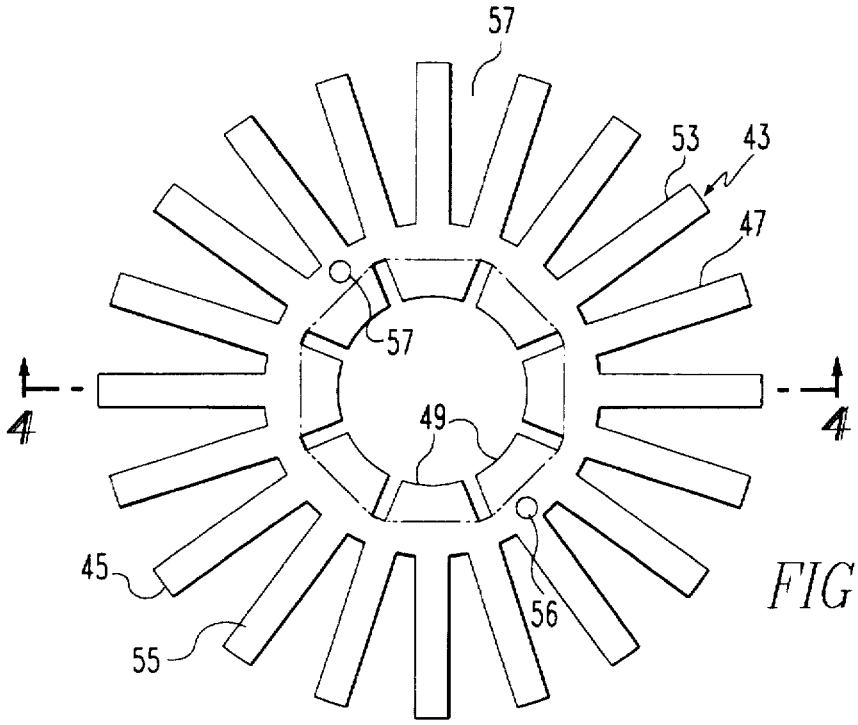
FIGS. 3 and 3*a* are plan views of a lamination used to form a heat sink in accordance with the first embodiment of the invention.

As will be seen, these heat sinks can be tailored to provide sufficient heat dissipation that the temperatures at the junctions 35 and 39 are maintained within the test standards. Preferably, each of the heat sinks 43 is constructed of a stack of laminations 45 each having a central opening 47, such as shown in FIG. 3. Projecting radially inward around the central opening 47 are a number of tabs 49 formed by radial slits 51. As shown in FIG. 4, the tabs 49 are bent out of the plane of the lamination, so that the lamination can be slid down over the contact stem 29 or 33. A fixture (not shown) is then used to flatten the tabs 49, which being harder than the copper of the stems 29 and 31, causes the edges to dig into and grip the stem thereby firmly securing the lamination to the contact stem.

Figure 3A:
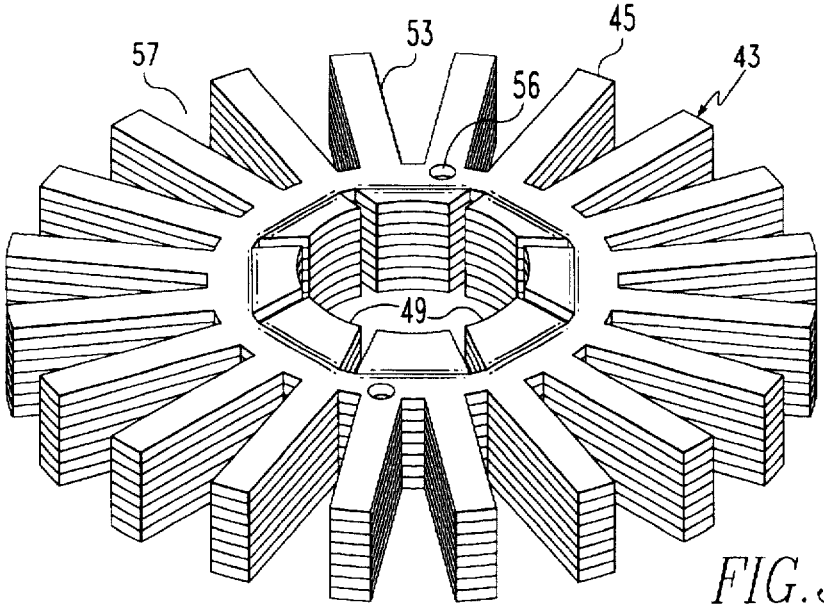

The embodiment of the heat sink 43 shown in FIGS. 3, 3*a*, and 4 includes a plurality of equiangularly spaced, radially extending slots 53 which divide the lamination 45 into a plurality radially extending fingers 55. One or more apertures 56 in the base of the lamination, help to align the fingers 55 of the stack of laminations 45 so that the slots 53 form axially extending passages 57 through the heat sink. The individual laminations can alternatively be aligned by inserting an elongated member (not shown) directly in the slots 53. As shown in FIG. 2, it is preferred that the heat sink 43 have a diameter greater than that of the vacuum bottle 19 so that cooling air can circulate more easily through the passages 57.

Figure 5:
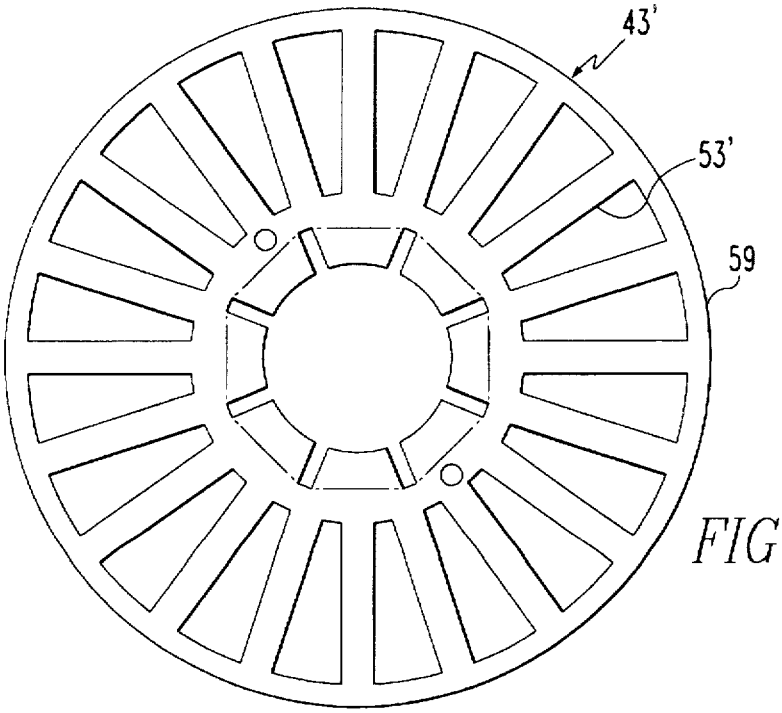
FIG. 5 is a plan view of a lamination in accordance with a second embodiment of the heat sink of the invention.

An alternate embodiment of the invention is disclosed in FIG. 5. Here, the slots 45' in the laminations 43 are enclosed by a continuous peripheral section 59 of each lamination. This embodiment is preferable in higher voltage applications in that it eliminates the sharp edges at the ends of the fingers 55 of the laminations 45 in FIGS. 3 and 4 thereby reducing the potential for flash over.

Figure 7:
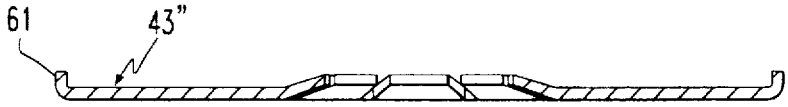
FIG. 7 is an edge view of the lamination of FIG. 6.
Figure 6:
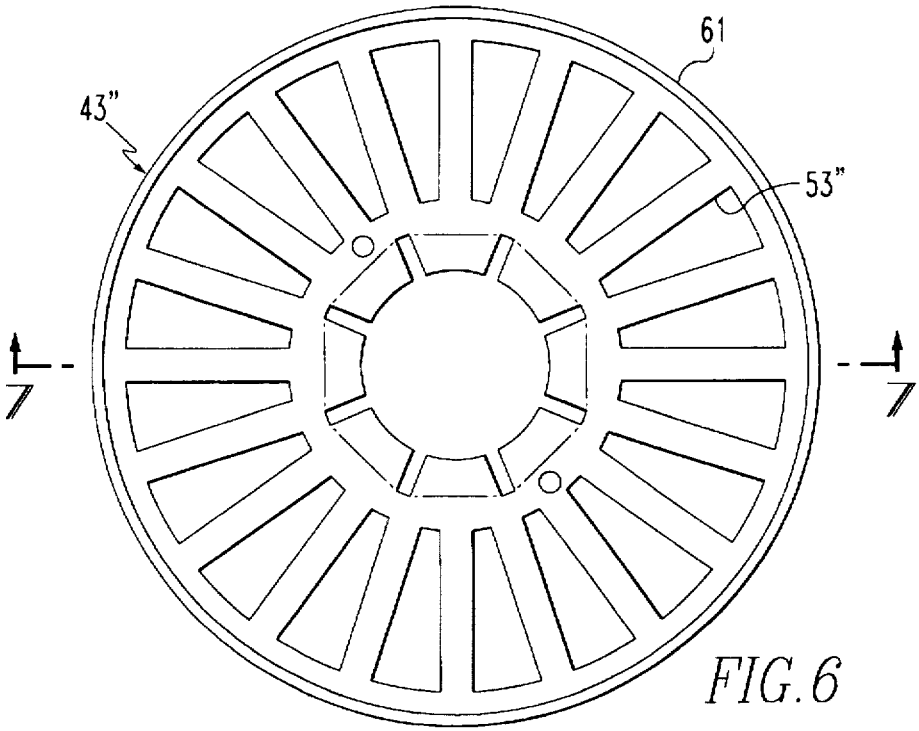
FIG. 6 is a plan view of a modification to the embodiment of FIG. 5.

A modification of this last embodiment is shown in FIGS. 6 and 7. In this embodiment, the laminations 45" have the enclosed slots 53" and a spacer in the form of a peripheral lip 61 extending axially out of the plane of the lamination. This lip 61, which may be continuous or interrupted, provides axial spacing between the stacked laminations 45", thereby presenting more surface area within the stack of laminations for cooling.

Figure 9:
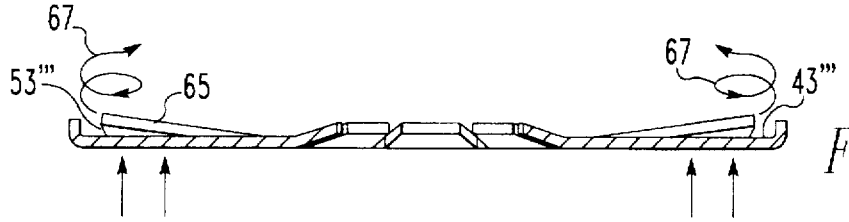
FIG. 9 is an edge view of the lamination of FIG. 8 also illustrating turbulent air flow generated by the lamination.
Figure 8:
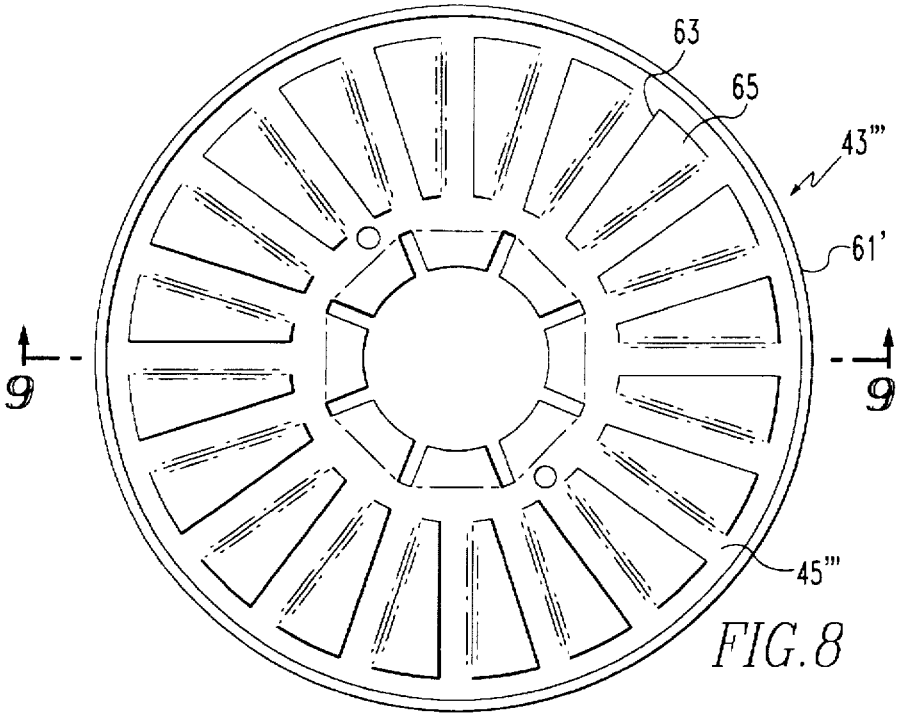
FIG. 8 is a plan view of a lamination in accordance with another embodiment of a heat sink in accordance with the invention.

Yet another embodiment of the invention is illustrated in FIGS. 8 and 9. In the embodiments of FIGS. 5, and 6 and 7, the enclosed slots 53' and 53" are formed by removing material from the respective lamination 45' and 45". In the embodiment of FIGS. 8 and 9, a slit 63 is cut through the lamination 45'" to define three sides of the slot 53'". The slit section 65 is then bent out of the plane of the lamination 45'" to form the vent section 65. The peripheral lip 61' extends axially at least as far as the vent section 65 extends axially out of the plane of the lamination 45'" so that the vent sections are not crushed flat when the laminations are stacked to form the heat sink. This embodiment provides maximum radiating surface together with the axially extending passages. It also provides the smooth peripheral surface which minimizes flash over. The vent sections 65 impart a swirling motion as indicated at 67 to cooling air passing through the laminations 45'" which increases cooling efficiency through increased contact by the cooling air with the successive laminations.

Figure 10:
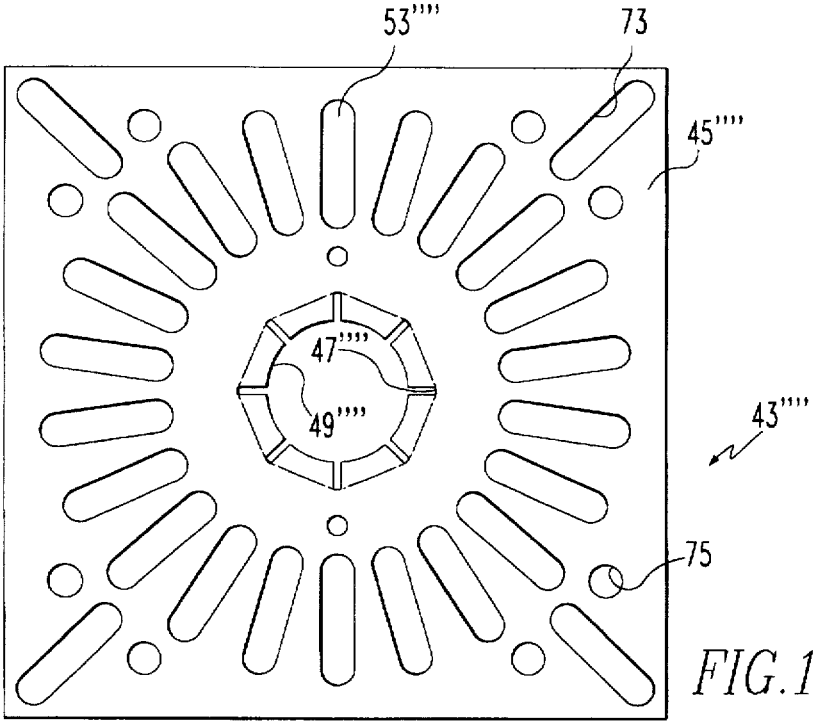
FIG. 10 is a plan view of yet another embodiment of a lamination of a heat sink in accordance with the invention.

Returning to FIG. 1, it can be seen that the support or frame 69 for the conductor 41 and line terminal 13 forms a rectangular space 71 around the fixed contact stem 29. To accommodate for this arrangement, yet another embodiment of the heat sink 43"" is shown in FIG. 10. In this embodiment, the laminations 45"", are rectangular rather than circular as in the case of the other embodiments specifically described. These laminations 45"" also have a central opening 47"" provided with tabs 49"" and enclosed radially extending slots 53"". It also has additional slots 73 in the corners, and may have other shaped slots 75 also. Of course, the slots 53 in all of the laminations 43 can have various other shapes.

Figure 11:
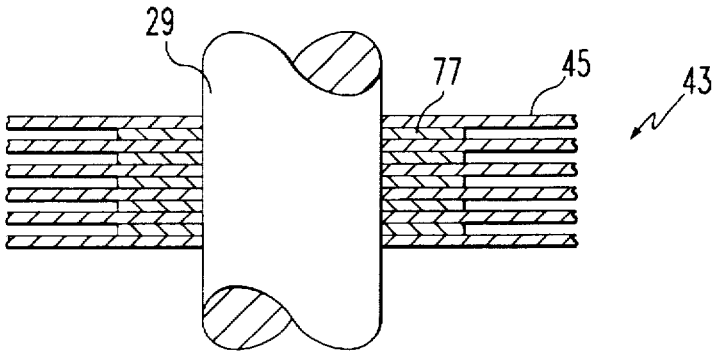
FIG. 11 is a vertical section through a heat sink having spacers between the laminations.
Figure 12:
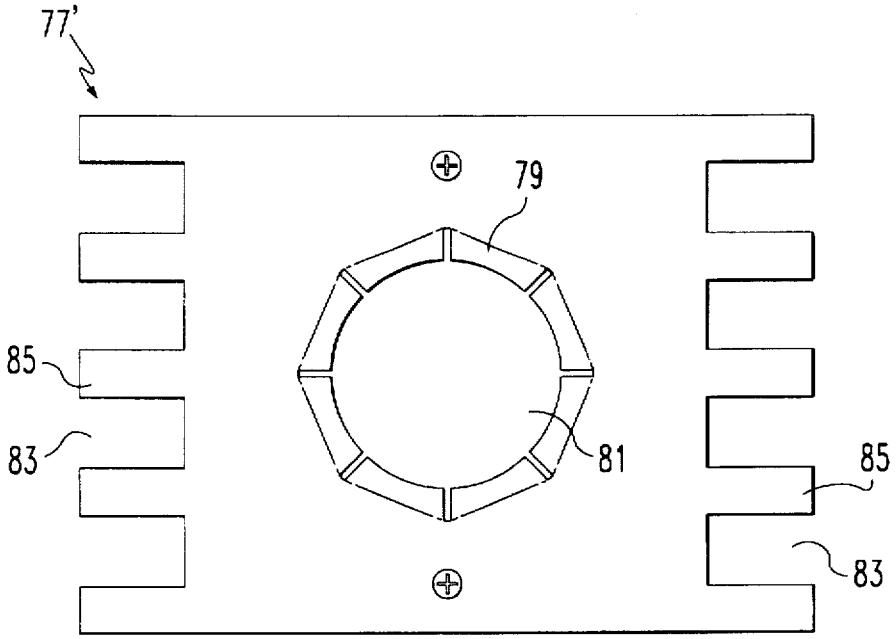
FIG. 12 is a plan view of a spacer.

As shown in FIG. 11, spacers 77 smaller in lateral dimensions that the laminations can be provided between or interleaved with at least some of the various types of laminations 45 to increase the surface area of those laminations exposed for heat dissipation. For this purpose, the spacers 77 do not have to have tabs which dig into the stem, and for that matter, do not have to contact the stem. However, as shown in FIG. 12, the spacers 77' can have generally radially inwardly extending bent tabs 79 around a central opening 81 which secure the spacers to the stems such as 29 in the same manner as the laminations. In this case, the spacers become heat radiators also and can have notches 83 in their periphery forming extensions 85 which further promote heat dissipation.

The heat sinks provided by the invention dissipate large amounts of heat from vacuum interrupters. These heat sinks are placed strategically between the vacuum interrupter and the closest current carrying device so that they are effective in helping especially the new smaller vacuum interrupters meet the temperature test standards. The various embodiments of the invention present large effective cooling surface area and have excellent heat conduction. The laminated structure provides flexibility in that the desired number and size of laminations can be selected to provide the desired heat dissipation. The heat sinks of the invention are cost effective as they use laminated sheet stock material, are easy to manufacture and install and can be easily customized for each application.

The assembly of the heat sink stack is such that it does not need mounting bolts since the laminations mount directly into the copper stem. The "saw-tooth" pattern of the connection embeds the heat sink into the copper stem. This prevents the heat sink from disengaging during operation. In addition, when the laminations penetrate the vacuum interrupter stems, the mating contact area is increased. This is due to the fact that the laminations are stronger than the copper so that the laminations penetrate the copper. The multi-point contact provided by this connection of the laminations to the contact stems provides low thermal and electrical resistances. Since the mounting does not have any bolted connections, there is no degradation of conductivity due to creep, and no maintenance is necessary. Furthermore, no adhesives or mounting compounds are needed. In addition, the connection does not create hot spots in the vacuum interrupter stems.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A heat sink for a vacuum interrupter having a vacuum bottle, and a pair of separable contacts mounted inside the vacuum bottle on contact stems which extend out of opposite ends of said vacuum bottle each for connection to an electrical conductor at a junction point on said contact stem spaced from said vacuum bottle, said heat sink comprising:

heat radiating means fixed to at least one of said contacts stems and extending radially outward therefrom between said vacuum bottle and said junction point.

2. The heat sink of claim 1 wherein said heat radiating means comprises a stack of laminations each having a central opening with at least one generally radially inwardly extending tab forming an interference fit with and securing said lamination to said at least one contact stem.

3. The heat sink of claim 2 wherein said laminations have aligned slots extending therethrough for passage of cooling air.

4. The heat sink of claim 3 wherein said aligned slots extend generally radially.

5. The heat sink of claim 2 wherein said aligned slots are enclosed.

6. The heat sink of claim 5 wherein said laminations are generally circular and said enclosed slots extend generally radially outward.

7. The heat sink of claim 6 wherein said laminations are generally planar and extend in a transverse plane generally perpendicular to said at least one contact stem, said slots comprising bent sections formed by slits and bent out of said transverse plane.

8. The heat sink of claim 7 wherein said laminations have spacer means spacing adjacent laminations apart to accommodate said vent sections.

9. The heat sink of claim 8 wherein said spacer means comprises peripheral lips bent out of said transverse planes of said laminations.

10. The heat sink of claim 1 wherein said heat radiating means has axially extending slots for passage of cooling air.

11. The heat sink of claim 10 wherein said axially extending slots are enclosed.

12. The heat sink of claim 11 wherein said heat radiating means comprises a stack of laminations having aligned enclosed slots.

13. The heat sink of claim 2 including spacers smaller in lateral dimension than said laminations interleaved with at least some of said laminations.

14. The heat sink of claim 13 wherein at least some said spacers have a central opening with at least one generally radially inwardly extending bent tab forming an interference fit with and securing said at least one spacer to the contact stem.

15. A vacuum interrupter comprising:

a vacuum chamber;

a fixed contact and a movable contact disposed within said vacuum chamber;

a fixed contact stem supporting said fixed contact in said vacuum chamber and extending outward from a first end of said vacuum chamber;

a movable contact stem supporting said movable contact in said vacuum chamber for reciprocal movement between contact with and separation from said fixed contact, said movable contact stem extending outward from a second end of said vacuum chamber;

a first electrical conductor connected to said fixed contact stem at a first junction spaced from said first end of said vacuum chamber;

a second electrical conductor connected to said movable contact stem at a second junction spaced from said second end of said vacuum chamber; and heat sink means affixed to at least one of said contact stems between an associated one of said junctions and an associated end of said vacuum chamber.

16. The vacuum interrupter of claim 15 wherein said vacuum chamber has a given radius and wherein said heat sink means extends radially outward from said at least one contact stem more than said given radius.

17. The vacuum interrupter of claim 15 including a frame defining a space around said associated junction between said at least one contact stem and an associated conductor, said heat sink means being affixed to said at least one stem and extending outward therefrom in said space.

18. The vacuum interrupter of claim 17 wherein said frame defines a rectangular space and wherein said heat sink means is rectangular.

19. The vacuum interrupter of claim 18 wherein said heat sink means has axially extending slots for passage of cooling air therethrough.

20. The vacuum interrupter of claim 19 wherein said heat sink means comprises a stack of laminations having aligned slots.

21. The vacuum interrupter of claim 15 wherein said heat sink means comprises a stack of laminations having aligned slots forming passages for cooling air.

22. The vacuum interrupter of claim 21 wherein each of said laminations has a central opening with at least one generally radially inwardly extending tab forming an interference fit with and securing said lamination to said at least one contact stem.

* * * * *